US005884538A

United States Patent [19]

Van Lenten

[11] Patent Number: 5,884,538

[45] Date of Patent: Mar. 23, 1999

[54] DETENT FOR A HAND TOOL

[75] Inventor: James A. Van Lenten, Lancaster, Pa.

[73] Assignee: Hand Tool Design Corporation, Wilmington, Del.

[21] Appl. No.: 874,873

[22] Filed: Jun. 13, 1997

[51] Int. Cl.[6] ..... B25B 13/46

[52] U.S. Cl. ..... 81/63; 192/41 S

[58] Field of Search ..... 81/60–63.2, 177.85; 279/79, 76; 192/43, 43.1, 43.2, 41 S

[56] References Cited

U.S. PATENT DOCUMENTS

| | | | |
|---|---|---|---|
| 138,973 | 5/1873 | Williams . | |
| 402,747 | 5/1889 | Laguire . | |
| 1,224,223 | 5/1917 | Sedgley . | |
| 1,854,513 | 4/1932 | Hummel . | |
| 2,138,332 | 11/1938 | Geisel | 192/43.1 |
| 2,521,419 | 9/1950 | Sellers | 81/63.1 |
| 2,852,874 | 9/1958 | Grubb . | |
| 2,982,161 | 5/1961 | Angquist et al. | 81/62 |
| 3,269,496 | 8/1966 | Kilness | 81/63.2 X |
| 5,233,891 | 8/1993 | Arnold et al. | 81/63.2 X |
| 5,619,891 | 4/1997 | Tiede | 81/62 |
| 5,713,251 | 2/1998 | Zurbuchen et al. | 81/61 |

*Primary Examiner*—D. S. Meislin
*Attorney, Agent, or Firm*—Leonard Bloom

[57] ABSTRACT

A ratchet wrench having a vertical bore in the handle. The vertical bore has a resilient member disposed therein. The resilient member has an enlarged central section. When the pawl of the ratchet wrench is moved from one alternate position to another, the enlarged central section is distorted.

10 Claims, 4 Drawing Sheets

DETENT FOR A HAND TOOL

BACKGROUND OF THE INVENTION

The present invention relates to a detent for a hand tool and more particularly to a detent having an enlarged central section which is disposed on a vertical axis in a bore in the hand tool.

The conventional detent used in hand tools such as ratchet wrenches, is a ball and spring disposed in a bore. The detent in the ratchet wrench which controls the movement of the pawl requires that the bore be formed angularly or perpendicularly into the handle and communicate with the opening in which the pawl is received. The center line and depth of the bore are critical to the proper function of the ratchet wrench. If not exactly accurate, there is the possibility of applying differing and varying torques when the direction of the pawl is reversed. In production of the ratchet wrenches, forming the bore is costly and time consuming. Further costs are incurred by rejection of inaccurately formed and/or out of tolerance bores. An additional problem is assembly of the ball and spring in a conventional detent means. The ball and/or the spring are frequently lost during assembly and repair. It is possible for employees to be injured by ejection of the small ball. Special tooling is required to install or remove the spring and ball. During maintenance and repair of the conventional wrench, the above-identified problems are present.

U.S. Pat. No. 138,973 disclosed a wrench having a duplex spring which is pressed by an eccentric to hold one member of a duplex pawl. U.S. Pat. No. 402,747 discloses a wrench in which a reversible pawl is operated by a spring which is received in a recess. In U.S. Pat. No. 1,224,223, there is disclosed a ratchet wrench having a pawl pivotably mounted on a handle and provided with two "dogs". On the side opposite the dogs is a tail, extending from each side of which are abutments. A resilient stop or spring is seated in a longitudinally-extending recess. The spring has an eye or loop which is adapted to engage one or the other of the oblique walls. U.S. Pat. No. 1,854,513 discloses a reversible ratchet wrench with a pawl and a wire of spring steel which is pivotably anchored in an aperture. The spring yields to an extent sufficient to permit the displacement of a pawl for temporary tooth disengagement until the succeeding ratchet tooth is engaged in response to a change in the direction of movement of the handle. U.S. Pat. No. 2,138,332 discloses a wrench having a spring member which has a vertical end portion and a V-shaped connecting portion. The spring engages the pawl.

These patents have not resolved the problem noted above and there still exists a need for a detent and a tool using the detent which addresses the problems.

BRIEF SUMMARY OF THE INVENTION

It is an object of the invention to provide a detent which is economical to manufacture, safe to assemble, requires no special tooling and is easily repaired and maintained.

It is a further object of the invention to provide a ratchet wrench which uses the detent and avoids the necessity of forming an inclined bore in the handle and eliminates the ball as part of the detent.

In accordance with the teachings of the present invention, there is disclosed a ratchet wrench which includes a handle and a reversible pawl which has alternate positions governing the respective forward and reverse operations of the wrench. The pawl pivots about a vertical axis which is substantially perpendicular to the handle. A vertical bore is formed in the handle substantially parallel to the axis of the pawl. A resilient means is disposed in the vertical bore and retained therein. The resilient means has an enlarged central section directly engaging the pawl in a normal partially unstressed configuration of the resilient means. The configuration of the resilient means is distorted as the pawl is moved from one alternate position to another. The resilient means then assumes its normal configuration when the pawl is substantially in its alternate position, thereby providing a resilient bias and a detent member in a single component, and thereby eliminating any necessity for drilling an inclined or perpendicular bore into the handle and for providing a ball cooperating with the spring.

These and other objects of the present invention will become apparent from a reading of the following specification taken in conjunction with the enclosed drawings.

BRIEF DESCRIPTION OF THE DRAWINGS

FIG. 3 is a partial cut-away top plan view showing the barrel spring in a partially unstressed condition in one pocket in the pawl.

FIG. 4 is a partial cut-away top plan view showing the enlarged central section of the barrel spring compressed as the pawl is in an intermediate position.

FIG. 5 is a partial cut-away top plan view showing the barrel spring in an unstressed condition in the other pocket in the pawl.

DESCRIPTION

Figure 1:
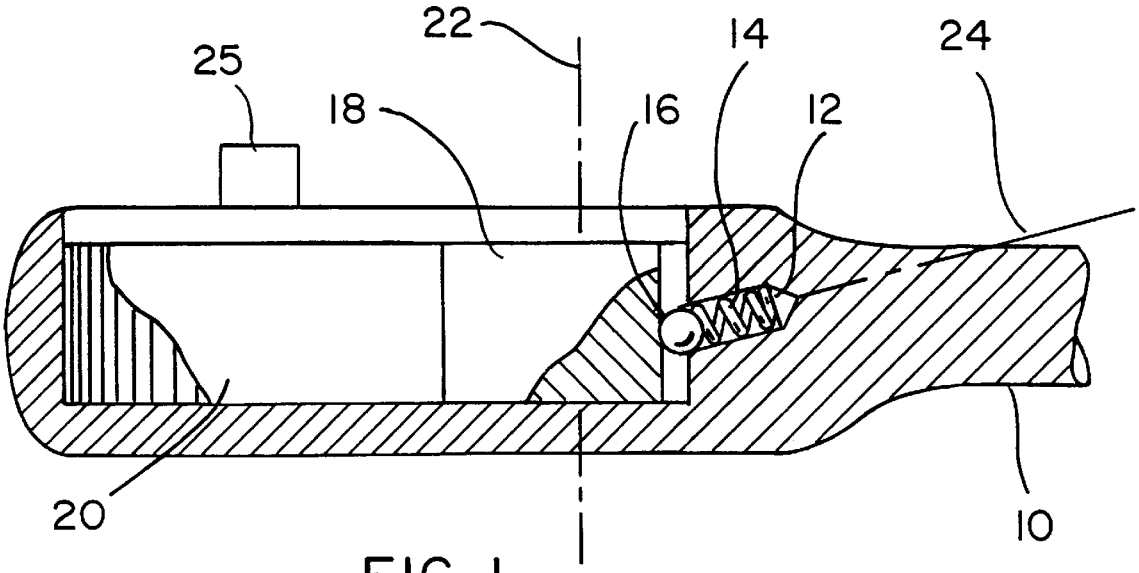
FIG. 1 PRIOR ART
FIG. 1 is a partial cut-away side elevation view of a ratchet wrench of the prior art showing a detent ball and compression spring in a slanted bore in the handle.

Referring now to FIG. 1, the ratchet wrench of the prior art has a handle 10 in which there is formed an inclined blind bore 12 in the handle 12 which is angled with respect to a center line through the handle. The blind bore 10 may also be formed perpendicularly with respect to opening in which the pawl 18 is disposed. Disposed in the bore 12 is a compression spring 14 having one end abutting the blind end of the bore 12 and the other end at the entrance to the bore. A ball 16 is disposed in the other end of the compression spring 14. The ball 16 contacts the pawl 18 which is disposed in an opening in the head of the ratchet wrench. Teeth on the pawl 18 engage teeth on a ratchet gear 20. The pawl 18 has a vertical axis of rotation 22. Movement of the pawl 18 about the axis of rotation 22 between two positions for forward and reverse operation of the wrench, causes the divider 38 between the pockets on the back face of the pawl to press the ball 16 into the bore 12 and longitudinally compress the spring 14 into the bore 12. The compression is in a direction which is along the center line 24 of the bore 12 and at an incline from the center line of the handle 10 or perpendicular to the vertical axis of rotation 22 of the pawl 18.

Figure 2:
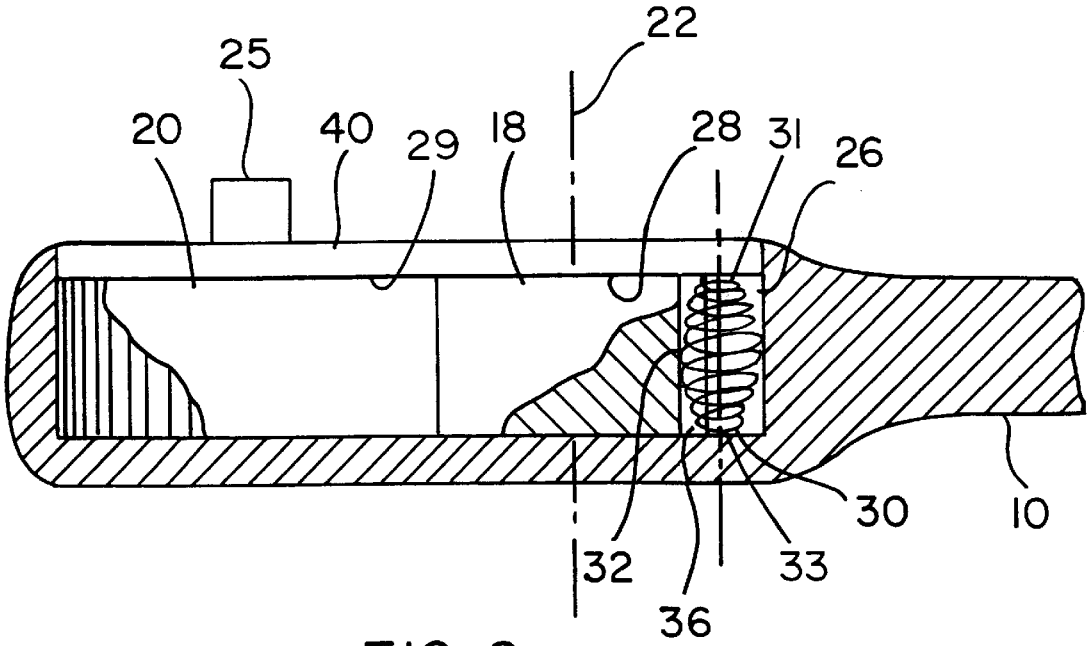
FIG. 2 is a partial cut-away side elevation view of the present invention showing a ratchet wrench having a barrel spring in a vertical bore.

The present invention is tool having a detent means, as for example, a wrench with a handle 10, a pawl 18 and a ratchet gear with a tang 25 as in the prior art. However, there is no bore inclined or perpendicular in the handle 10. Neither is there a ball cooperating with a detent compression spring. As shown in FIG. 2, the present invention discloses a vertical bore 26 formed in the handle 10 at the interface of the handle 10 with the pawl opening 28 in the head of the wrench. The vertical bore 26 is substantially parallel with the vertical axis of rotation 22 of the pawl 18 and the vertical bore 26 communicates with the opening for the pawl in the head of the ratchet wrench. The pawl opening further communicating with a ratchet gear opening 29, substantially parallel to the pawl opening 28. A resilient means 30 having an enlarged central section 32 is disposed in the vertical bore 26 such that the enlarged central section 32 contacts the back face of the pawl 18.

The vertical bore 26 is formed with a diameter slightly less than the maximum diameter of the resilient means 30. Alternately, the vertical bore 26 is formed adjoining the opening for the pawl 18 such that the enlarged central section 32 (having the maximum diameter) extends slightly into the pawl opening. In this manner, there is always a partial stress on the resilient means 30.

Figure 3:
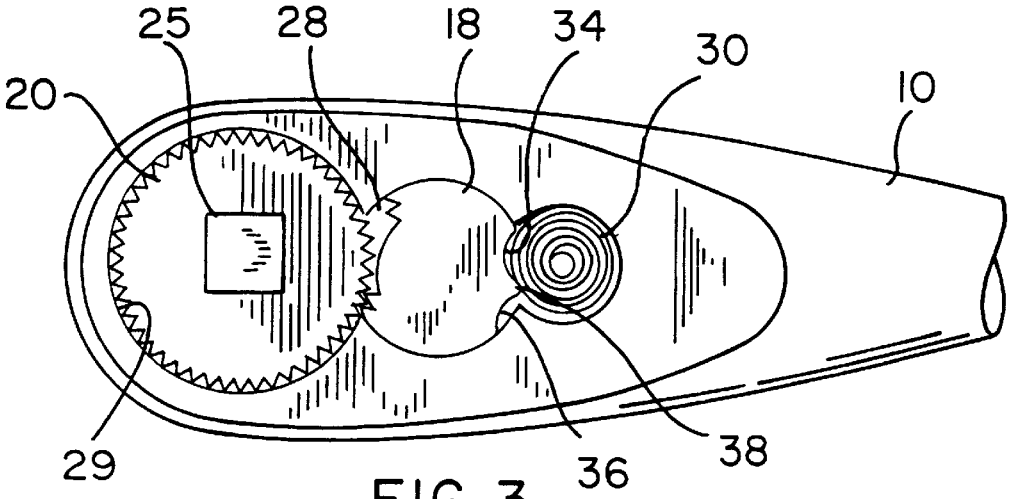
FIGS. 3–5 is a sequence showing compression of the barrel spring as the pawl is moved between forward and reverse positions with the cover plate removed.
Figure 4:
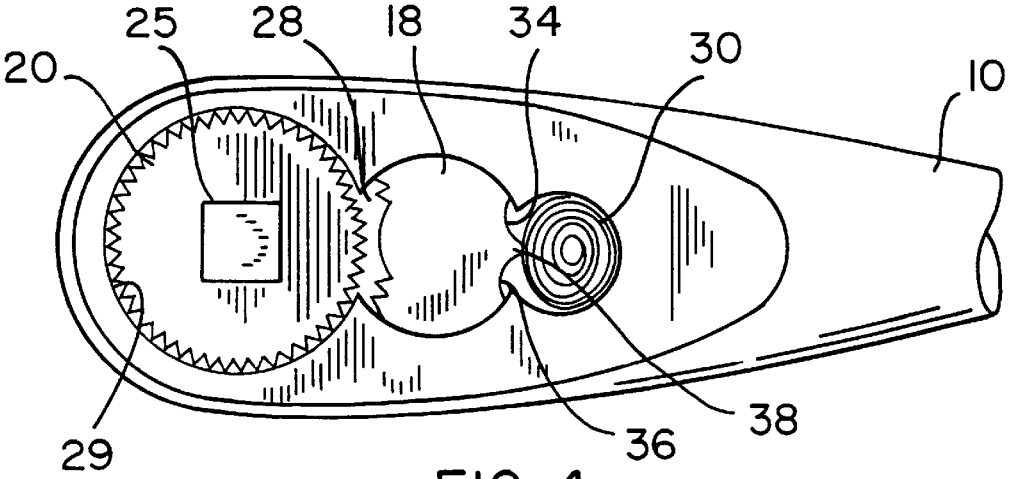
Figure 5:
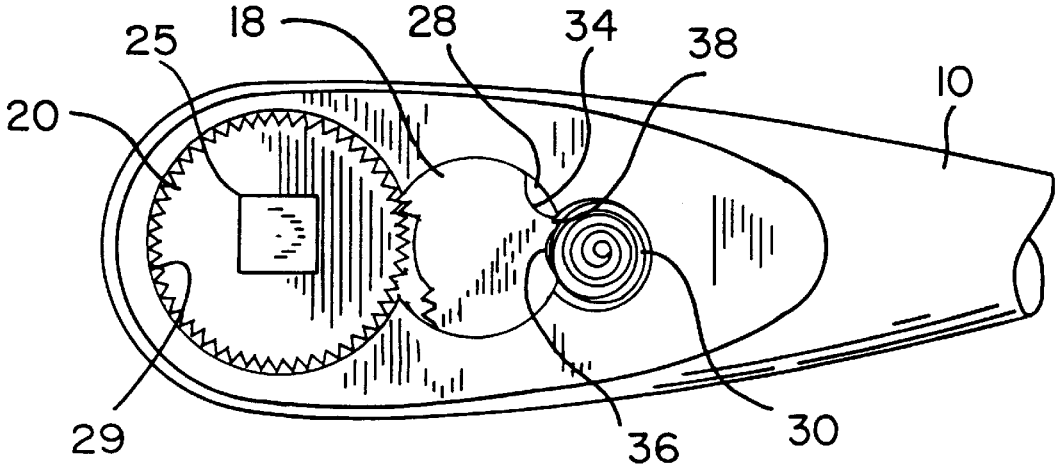

When the pawl 18 is pivoted for forward or reverse operation of the ratchet wrench about the vertical axis 22, which is substantially perpendicular to the handle, the resilient means 30 is initially disposed in the first pocket 34 on the back face of the pawl 18 (FIG. 3). The resilient means 30 is in a normal, partially unstressed configuration. As the pawl 18 pivots, the divider 38 between the pockets 34, 36 contacts the enlarged central portion 32 of the resilient means 30 and distorts the configuration of the resilient means 30. The central portion 32 is compressed toward the handle 10, acting in the manner of a detent (FIG. 4). As the pawl 18 is further pivoted, the resilient means 30 is disposed in the second pocket 36 in the pawl and assumes its normal, partially undistorted configuration (FIG. 5).

Thus, the present invention is a detent means which does not require a ball to be used in conjunction with a compression spring. The present invention avoids the attendant problems associated with possible loss of the small ball, and injury to persons by ejection of the ball plus the savings of not providing a ball. In addition, there is no need for the costly and exacting forming of a bore in the handle. Rather, the bore 26 of the present invention is vertical with respect to the head. The bore may be closed by a cover plate 40 which is commonly used to cover the gear and pawl openings in the head of a ratchet wrench. The bore 26 may be formed from the top of the head or the bottom of the head with the cover plate being disposed accordingly. Other methods of forming the bore, known to persons skilled in the art, may be used. The forming of the bore does not require exact tolerances as in the inclined or perpendicular bore of the prior art. There is a resulting savings in production costs in forming the bore and also the losses due to out-of-tolerance tools is significantly reduced.

Figure 6:
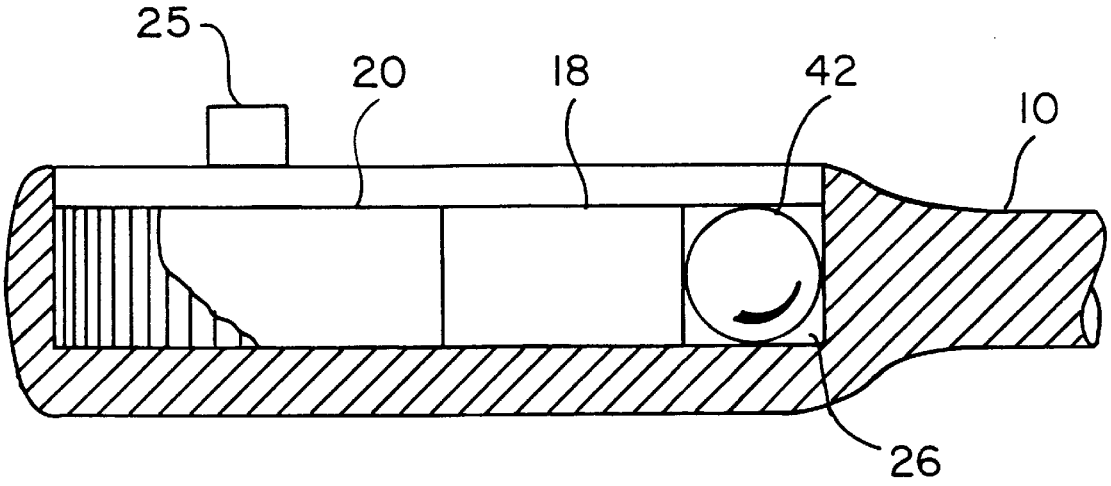
FIG. 6 is a partial cut-away side elevation view of the present invention where the resilient means is an elastomeric ball.
Figure 7:
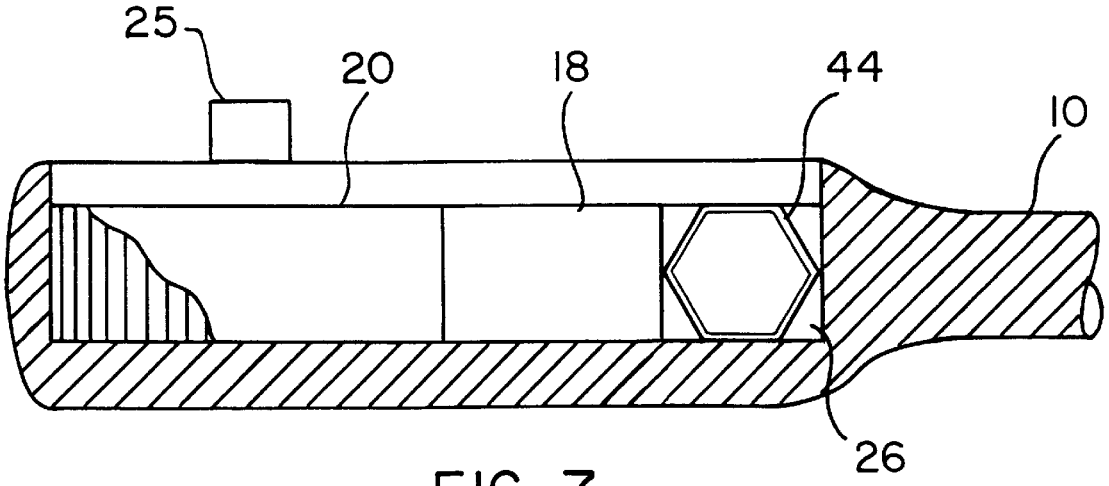
FIG. 7 is a partial cut-away side elevation view of the present invention where the resilient means is a hexagonal spring.
Figure 8:
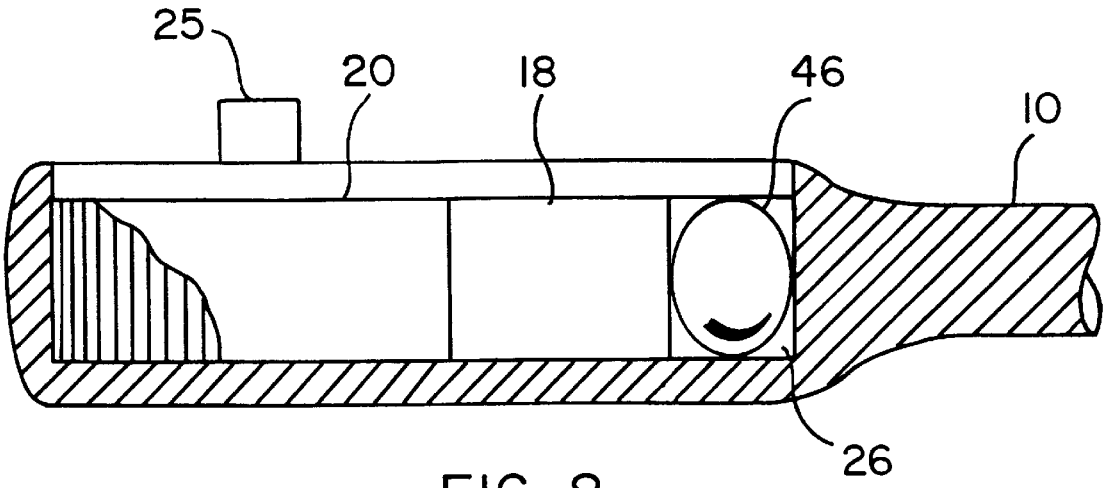
FIG. 8 is a partial cut-away side elevation view of the present invention where the resilient means is an elastomeric ovaloid.
Figure 9:
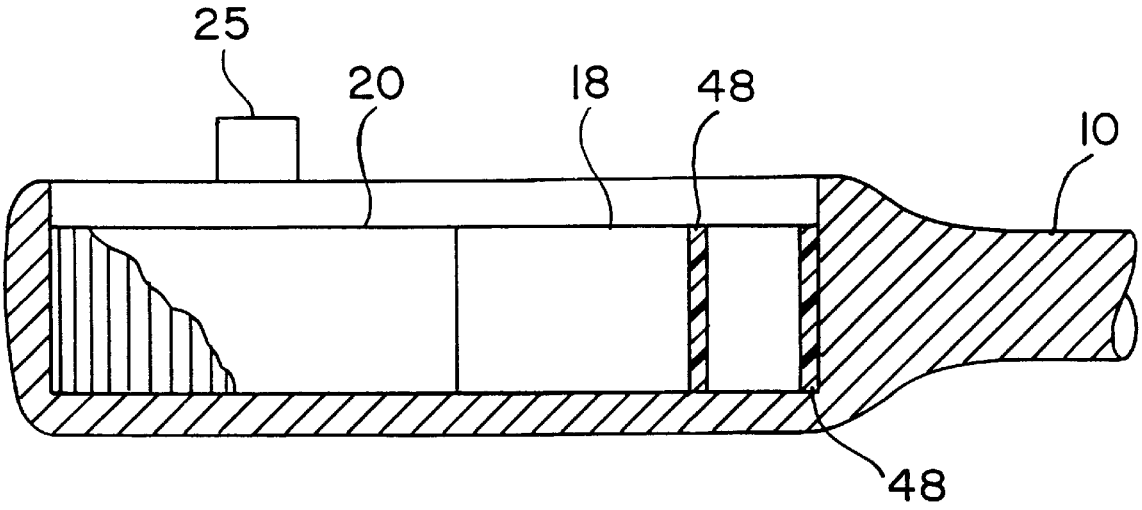
FIG. 9 is a partial cut-away side elevation view of the present invention where the resilient means is an elastomeric sleeve in cross section.

The resilient means 30 may be of a barrel spring as shown in FIGS. 2–5. The barrel spring has two opposite ends 31,33, each having a respective diameter. Preferably, the diameters of the ends 31,33 are equal to one another. The central section of the barrel spring has a diameter which is greater than the diameter of the respective ends 31,33. The helix spring has a progressively increasing diameter from the respective ends to the central section. However, the resilient means 30 is not limited to a spring. It may be an elastomeric ball, either solid or hollow as shown in FIG. 6. The spring 44 may have a hexagonal form, a U-shaped form or otherwise bowed to have portions juxtapositioned to the top and bottom of the bore with an enlarged central section to contact the pawl 18. The spring may be metallic or plastic. The resilient means 30 may also be ovaloid 46 in shape (FIG. 8), either solid or hollow. Further, the resilient means may be an elastomer sleeve 48 with a hollow center. The nature of the elastomeric and the thickness of the walls of the sleeve determine the resiliency of the elastomeric sleeve 48. The configuration of the resilient means 30 is not limited to those described herein but may be configurations having an enlarged central section and known to persons skilled in the art.

The resilient means 30 of the present invention may be used in any tool where a detent is required and where it is possible to provide a vertical bore juxtapositioned to a tool member which moves between two positions.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a ratchet wrench, wherein the ratchet wrench includes a handle and an adjoining head, and wherein a reversible pawl is disposed in a pawl opening in the head of the wrench, the reversible pawl having alternate positions governing the respective forward and reverse operations of the ratchet wrench, the pawl pivoting about a vertical axis which is substantially perpendicular to the handle, the combination of a vertical bore formed in the handle substantially parallel to the vertical axis and communicating with the pawl opening, a resilient means in the vertical bore and retained therein, and the resilient means having a first end, an opposite second end and at least one section therebetween, the at least one section being enlarged with respect to the ends, the enlarged section directly engaging the pawl in a normal partially unstressed configuration of the resilient means, such that the configuration of the resilient means is distorted as the pawl is moved from one alternate position to another, and such that the resilient means then assumes its normal configuration when the pawl is substantially in its alternate position, thereby providing a resilient bias and a detent member in a single component, and thereby eliminating any necessity for drilling an inclined or perpendicular bore into the handle and for providing a ball cooperating with the spring.

2. The ratchet wrench of claim 1, wherein the resilient means is a helical barrel spring having a first end and an opposite second end the ends each having a diameter, the central section having a diameter larger than the diameter of the respective ends.

3. The ratchet wrench of claim 1, wherein the resilient means is an elastomeric ovaloid.

4. The ratchet wrench of claim 1, wherein the resilient means is a hexagonal spring.

5. In a ratchet wrench, wherein the ratchet wrench includes a handle and an adjoining head, and wherein a reversible pawl is disposed in a pawl opening in the head of the wrench, the reversible pawl having alternate positions governing the respective forward and reverse operations of the ratchet wrench, the pawl pivoting about a vertical axis which is substantially perpendicular to the handle, the combination of a vertical bore formed in the handle substantially parallel to and communicating with, the pawl opening, a resilient elastomeric sleeve having a hollow center in the vertical bore and retained therein, the elastomeric sleeve directly engaging the pawl in a normal partially unstressed configuration of the resilient sleeve, such that the configuration of the resilient sleeve is distorted as the pawl is moved from one alternate position to another, and such that the resilient sleeve then assumes its normal configuration when the pawl is substantially in its alternate position, thereby providing a resilient bias and a detent member in a single component, and thereby eliminating any necessity for drilling an inclined or perpendicular bore into the handle and for providing a ball cooperating with the spring.

6. A ratchet wrench having a handle in a plane and an adjoining head, the head having three parallel, overlapping and communicating openings formed therein, the ratchet wrench comprising:

a ratchet gear disposed in the first opening, a reversible pawl disposed in the center opening and a resilient means disposed axially in the third opening, the pawl pivoting about a vertical axis which is substantially perpendicular to the plane of the handle, the pawl having alternate positions governing the respective forward and reverse operations of the ratchet wrench, the pawl having a back face oriented toward the resilient means, the back face having a pair of pockets formed therein, the pockets being separated by a divider, a portion of the resilient means having a maximum cross-section in a plane parallel to the plane of the handle such that said portion of the resilient means is received in one of the pockets in the back face of the pawl and pivoting of the pawl initially causes said portion of the resilient means to be compressed by the divider, said portion of the resilient means then expanding into the other pocket in the back face of the pawl as the pawl is disposed for forward or reverse operation, the resilient means serving as a detent.

7. The ratchet wrench of claim 6, wherein the resilient means is a helical barrel spring.

8. The ratchet wrench of claim 6, wherein the resilient means is an elastomeric ball.

9. The ratchet wrench of claim 6, wherein the resilient means is an elastomeric ovaloid.

10. In a ratchet wrench, wherein the ratchet wrench includes a handle and an adjoining head, and wherein a reversible pawl is disposed in a pawl opening in the head of the wrench, the reversible pawl having alternate positions governing the respective forward and reverse operations of the ratchet wrench, the pawl pivoting about a vertical axis which is substantially perpendicular to the handle, the combination of a vertical bore formed in the handle substantially parallel to and communicating with, the pawl opening, a resilient elastomeric ball disposed in the vertical bore and retained therein, the elastomeric ball directly engaging the pawl in a normal partially unstressed configuration of the resilient ball, such that the configuration of the resilient ball is distorted as the pawl is moved from one alternate position to another, and such that the resilient ball then assumes its normal configuration when the pawl is substantially in its alternate position, thereby providing a resilient bias and a detent member in a single component, and thereby eliminating any necessity for drilling an inclined or perpendicular bore into the handle and for providing a ball cooperating with the spring.

* * * * *